US010167058B2

(12) United States Patent
Shearer et al.

(10) Patent No.: US 10,167,058 B2
(45) Date of Patent: Jan. 1, 2019

(54) RETRACTABLE ROOF

(71) Applicant: Taylor Made Group, LLC, Gloversville, NY (US)

(72) Inventors: Robert R. Shearer, Bradenton, FL (US); Donald A. Zirkelbach, Bradenton, FL (US); Charles Robert Withers, Bradenton, FL (US)

(73) Assignee: TAYLOR MADE GROUP, LLC, Gloversville, NY (US)

( * ) Notice: Subject to any disclaimer, the term of this patent is extended or adjusted under 35 U.S.C. 154(b) by 0 days.

(21) Appl. No.: 15/276,418

(22) Filed: Sep. 26, 2016

(65) Prior Publication Data

US 2017/0088237 A1 Mar. 30, 2017

Related U.S. Application Data

(60) Provisional application No. 62/222,838, filed on Sep. 24, 2015.

(51) Int. Cl.
*B63B 17/02* (2006.01)

(52) U.S. Cl.
CPC ..... *B63B 17/02* (2013.01); *B63B 2017/026* (2013.01)

(58) Field of Classification Search
CPC . B63B 17/02; B63B 17/023; B63B 2017/026; B60J 7/061; B60J 7/067
See application file for complete search history.

(56) References Cited

U.S. PATENT DOCUMENTS

| | | | | |
|---|---|---|---|---|
| 4,157,845 | A | 6/1979 | Queveau | |
| 4,259,660 | A | 3/1981 | Oliver | |
| 5,647,630 | A | 7/1997 | Jambor et al. | |
| 6,019,416 | A | 2/2000 | Beierl | |
| 6,767,046 | B1 | 7/2004 | Guillez et al. | |
| 6,786,528 | B2 | 9/2004 | Guillez et al. | |
| 6,799,789 | B2 | 10/2004 | Guillez et al. | |
| 6,935,675 | B2 | 8/2005 | Kubota et al. | |
| 7,036,866 | B2 | 5/2006 | Perakis | |
| 7,185,940 | B2 | 3/2007 | Queveau et al. | |
| 7,278,675 | B2 | 10/2007 | Queveau et al. | |
| 7,309,098 | B2 | 12/2007 | Neubrand | |
| 7,513,563 | B2 | 4/2009 | Guillez et al. | |
| 7,543,878 | B2 | 6/2009 | Lang | |
| 8,167,355 | B2 | 5/2012 | Guetet | |
| 2005/0204994 | A1* | 9/2005 | Miotto | B60J 7/04 114/361 |

* cited by examiner

*Primary Examiner* — Andrew Polay
(74) *Attorney, Agent, or Firm* — Nixon & Vanderhye P.C.

(57) ABSTRACT

A retractable roof includes a pair of tracks oriented lengthwise along opposite sides of an opening, a plurality of traveler cars displaceable on the tracks manually or by motor, and a plurality of bows coupled with the traveler cars and extending between the tracks and across the opening. The bows are displaceable with the traveler cars between a closed position and an opened position. A roof material sized to cover the opening is secured to the bows.

17 Claims, 13 Drawing Sheets

RETRACTABLE ROOF

CROSS-REFERENCES TO RELATED APPLICATIONS

This application claims the benefit of U.S. Provisional Patent Application No. 62/222,838, filed Sep. 24, 2015, the entire content of which is herein incorporated by reference.

STATEMENT REGARDING FEDERALLY SPONSORED RESEARCH OR DEVELOPMENT (Not Applicable)

BACKGROUND

The invention relates generally to a retractable roof suitable for any opening and, more particularly, to a manual or motorized retractable roof including an easily displaceable structural configuration for selectively displacing the retractable roof into a desired position.

A center console boat typically has a helm or console located centrally in the boat. Above the console, there is usually some sort of enclosure or shade that partially protects the occupants from the elements. This is usually a structure commonly referred to as a T-Top or Tower enclosure. The enclosure is typically fabricated from a tubular construction. The top (protective) portion can be covered with fabric or could be made of a composite construction.

Occasionally, some or all of the occupants would care to enjoy the sunshine, warmth, and/or the overhead view while located under the enclosure. Other times, the occupants want to be protected from the elements.

BRIEF SUMMARY

A retractable roof may be manually retractable, electrically retractable, pneumatically retractable, or the like. In an exemplary application to a center console boat, the console roof includes an opening with tracks therein. A flexible material is mounted on a carrier that is supported in the tracks. The cover structure is configured to fold on itself as the carrier is displaced from a closed roof position to an open roof position.

In an exemplary embodiment, a retractable roof is positionable in an opening and includes a pair of tracks oriented lengthwise along opposite sides of the opening. An end frame assembly extends across the opening between the tracks and includes a bow frame secured to end frame traveler cars movably mounted on the tracks. A flexible roof material sized to cover the opening is secured to the end frame assembly. The end frame assembly may be displaceable between a closed position and an opened position, and the flexible roof material may be configured to fold on itself as the end frame assembly is displaced to the opened position.

The retractable roof may include an interim bow assembly, possibly at least two, with an interim bow extending across the opening between the tracks. The interim bows may be secured to bow traveler cars movably mounted on the tracks. In this context, the flexible roof material is also secured to the interim bows.

The end frame assembly may be secured to the end frame traveler cars and the interim bow assembly may be secured to the bow traveler cars by respective hinge assemblies. In this context, each of the hinge assemblies may include a hinge block pivotably secured to respective ones of the traveler cars and a spring interposed between the hinge block and the respective ones of the traveler cars. The bow frame and the interim bow may be secured to the hinge block of a respective hinge assembly, where the springs of the hinge assemblies on one side of the tracks act in opposition to the springs of the hinge assemblies on an opposite side of the tracks.

The retractable roof may also include a plurality of locking blocks positioned adjacent the tracks and spaced along a length of the tracks, where the end frame assembly may include a latch mechanism selectively engageable with the locking blocks. In this context, the locking blocks may each have a cavity or slot, and the latch mechanism may include a spring plunger selectively engageable with the cavities/slots in the locking blocks. The spring plunger is biased toward an engaged position. The latch mechanism may include a pull cord connected to a cable, where the cable is connected to the spring plunger. Displacement of the pull cord serves to displace the cable and retract the spring plunger against the bias.

The locking blocks may be provided with fore and aft tapered surfaces.

The end frame traveler cars and the bow traveler cars may be connected to a drive cable, and the retractable roof may further include an electric motor that drives the drive cable in forward and rearward directions.

In another exemplary embodiment, a retractable roof includes a pair of tracks oriented lengthwise along opposite sides of the opening, a plurality of traveler cars displaceable on the tracks, and a plurality of bows coupled with the traveler cars and extending between the tracks and across the opening. The bows are displaceable with the traveler cars between a closed position and an opened position. A roof material sized to cover the opening and secured to the bows. The roof material is configured to either fold on itself as the bows are displaced to the opened position or to be displaced up and over or down and under the opening as the bows are displaced to the opened position.

BRIEF DESCRIPTION OF THE DRAWINGS

These and other aspects and advantages will be described in detail with reference to the accompanying drawings, in which.

DETAILED DESCRIPTION

The retractable roof of the present application is described in an exemplary context as part of a boat enclosure. The retractable roof, however, may be applicable to any opening in which it is desired to open and close the space. As such, the invention is not intended to be limited to the described exemplary application.

Figure 1:
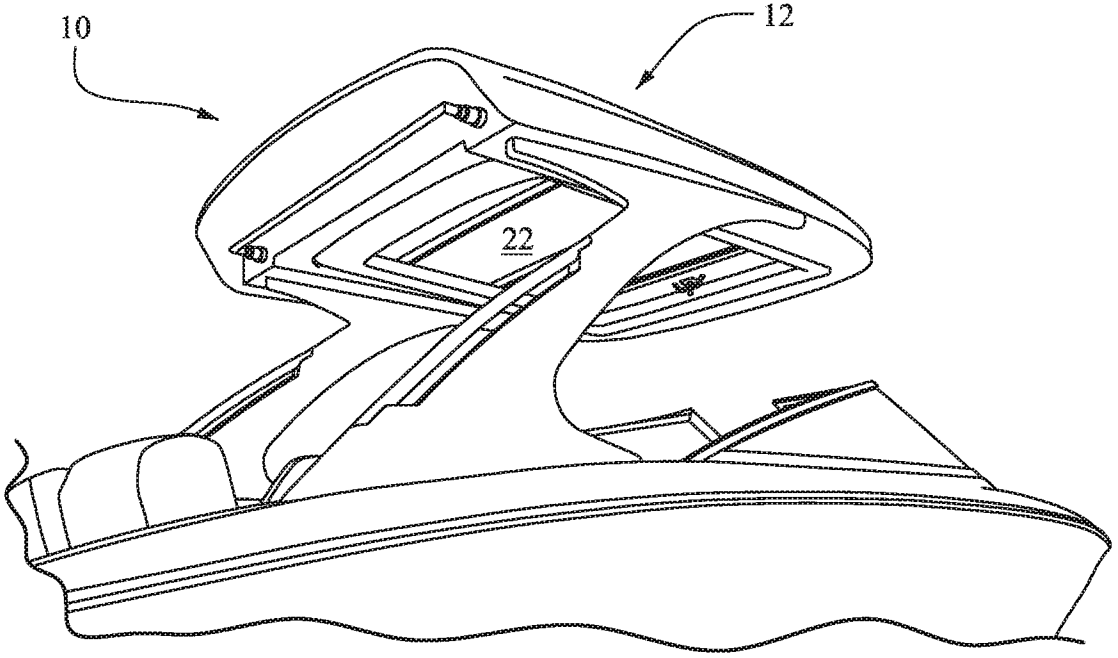
FIG. 1 shows an exemplary retractable roof installed over an operator area of a boat.
Figure 2:
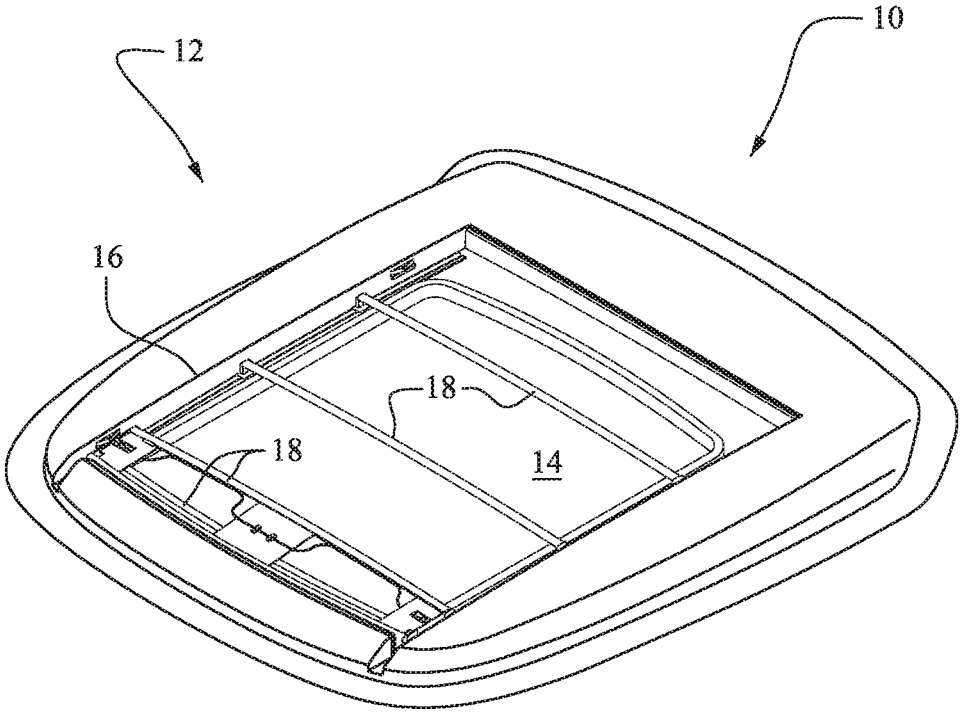
FIG. 2 shows the retractable roof in a closed position without the roof material.
Figure 3:
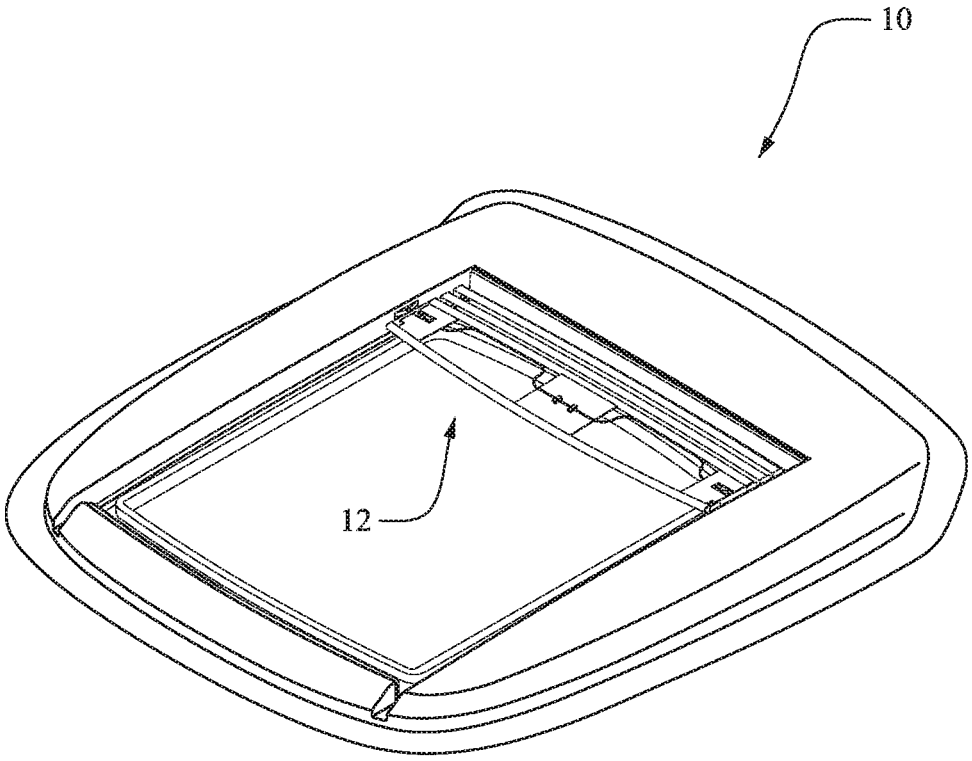
FIG. 3 shows the retractable roof in an opened position without the roof material.

FIG. 1 shows a boat including a cover structure 10 over an operator area. The cover structure 10 is provided with a retractable roof 12 including a flexible roof material 22. FIG. 2 shows the cover structure 10 with components of the retractable roof 12 in a closed position, and FIG. 3 shows the components of the retractable roof 12 in an opened position. As shown, the retractable roof 12 is positionable in an opening 14 in the cover structure 10 or the like. A pair of tracks 16 are oriented lengthwise along opposite sides of the opening 14. A plurality of bows 18 extend between the tracks 16 and across the opening 14. The bows 18 are connected at ends thereof to respective traveler cars 20 that are displaceable on the tracks 16. The flexible roof material 22 is sized to cover the opening 14 and is secured to the bows 18. The flexible roof material 22 may be fabric or an alternative more rigid structure provided that the material is foldable on itself as the bows 18 are displaced to the opened position.

Figure 4:
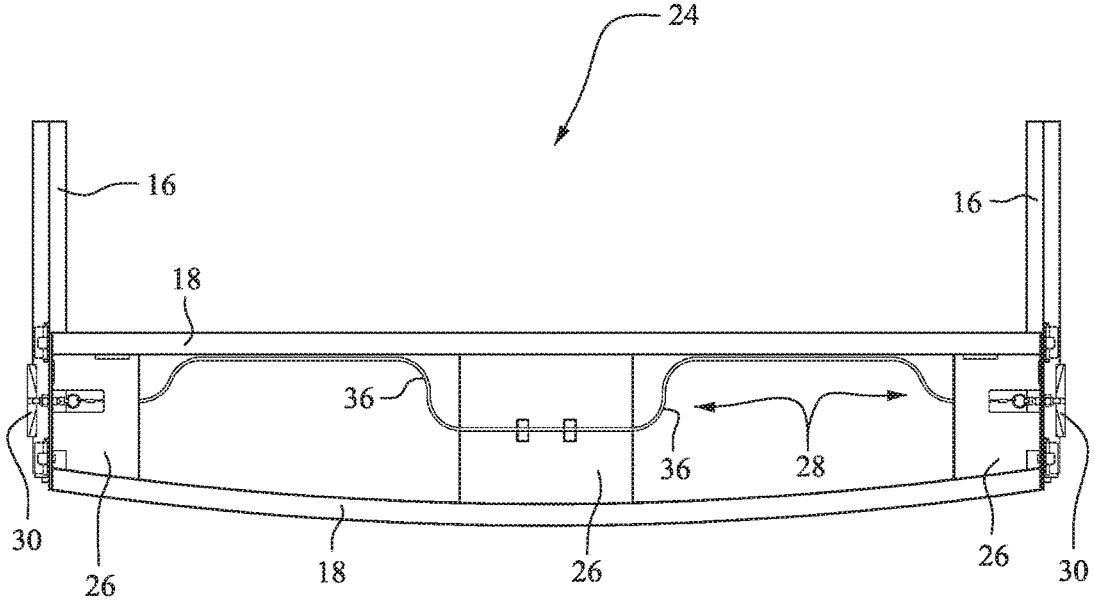
FIG. 4 is a plan view of an end frame assembly.
Figure 5:
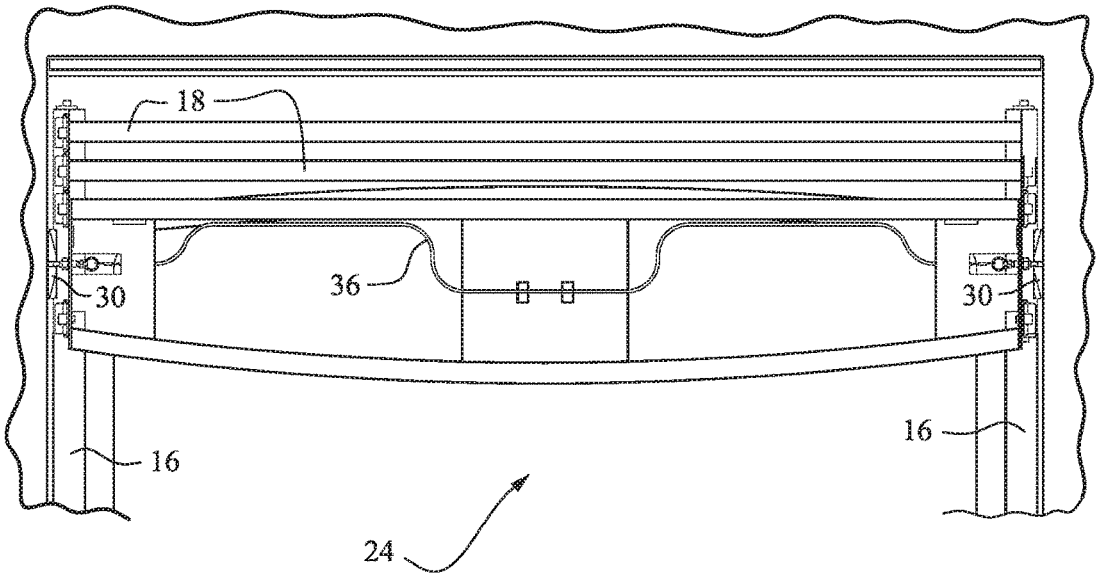
FIG. 5 shows the end frame assembly and bows in an open position.

In some embodiments, with reference to FIGS. 4 and 5, two or more of the bows 18 may be connected together by a framework to define an end frame assembly 24. The exemplary framework shown in FIGS. 4 and 5 includes three connector plates 26 secured between adjacent bows 18. The bows 18 of the end frame assembly 24 are thus displaceable together. The remaining bows 18 define respective interim bow assemblies with the bows extending across the opening 14 between the tracks 16 and secured to respective traveler cars 20 mounted on the tracks 16.

Figure 6:
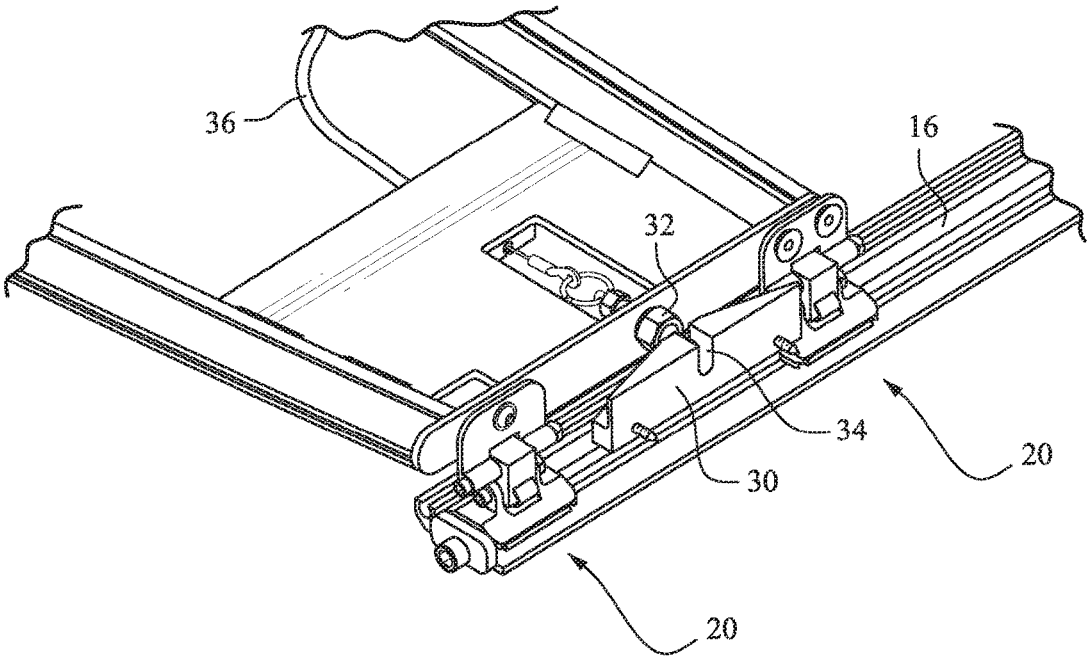
FIG. 6 shows details of the connections between the bows and the tracks.

As noted above, the retractable roof 12 may be displaceable manually, using a pneumatic assist, or with an electric motor or the like. In an embodiment where the retractable roof 12 is displaced manually, a latch mechanism 28 may be supported by or associated with the end frame assembly 24. With reference to FIGS. 4-6, a plurality of locking blocks 30 may be positioned adjacent the tracks 16 and spaced along a length of the tracks 16. The locking blocks 30 provide discrete locations for locking positions of the retractable roof between the fully closed position and the fully opened position. The latch mechanism 28 includes a spring plunger 32 that is selectively engageable with a slot or cavity 34 in each of the locking blocks 30. Preferably, the spring plunger 32 is biased toward an engaged/extended position. The plungers 32 engage the locking blocks 30 to lock the end frame assembly 24, and thereby a position of the retractable roof, at the discrete locations corresponding to the locations of the locking blocks 30 along the tracks 16.

Figure 7:
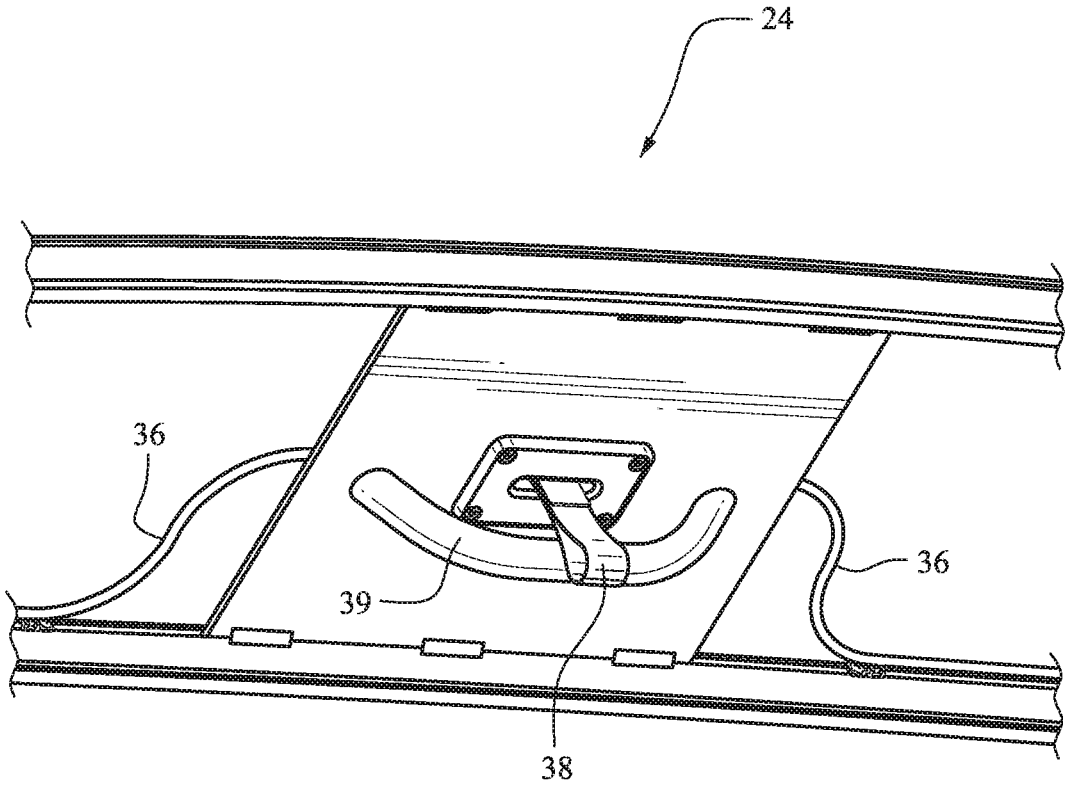
FIG. 7 shows a handle and a pull tab from a latch assembly on an underside of the end frame assembly.

The spring plungers 32 are released by actuating a wire cable 36 by a pull cord 38 (see FIG. 7). Displacement of the pull cord 38 serves to displace/retract the cable and thereby retract the spring plungers 32 against the bias of the spring. When the pull cord 38 is displaced by the operator, the plungers 32 are retracted from the slot/cavity 34 in the locking blocks 30, thereby allowing the retractable roof to slide or roll freely along the tracks 16 until the next locking block 30 is encountered. A handle 39 may be secured on an underside of the connector plate 26 to facilitate manual opening and closing of the retractable roof. As shown, the locking blocks 30 include fore and aft tapered surfaces. As such, the leading and trailing edges of the locking blocks are angled to allow the plunger 32 to gradually slide along the ramp surface into engagement with the locking blocks 30. When the plungers 32 reach the slots/cavities 34 in the locking block 30, the retractable roof is automatically locked in position. Of course, automatic locking can be prevented by actuating the pull cord 38 as the roof is traversed past the locking blocks 30 to thereby allow the roof to lock at an alternative location. When the pull cord is pulled downward (or away from the roof structure), the wire cable is displaced to force the spring plungers 32 to retract. The construction of the latch mechanism may also be provided with pulleys or other suitable structure to facilitate displacement of the spring plungers 32.

Figure 8:
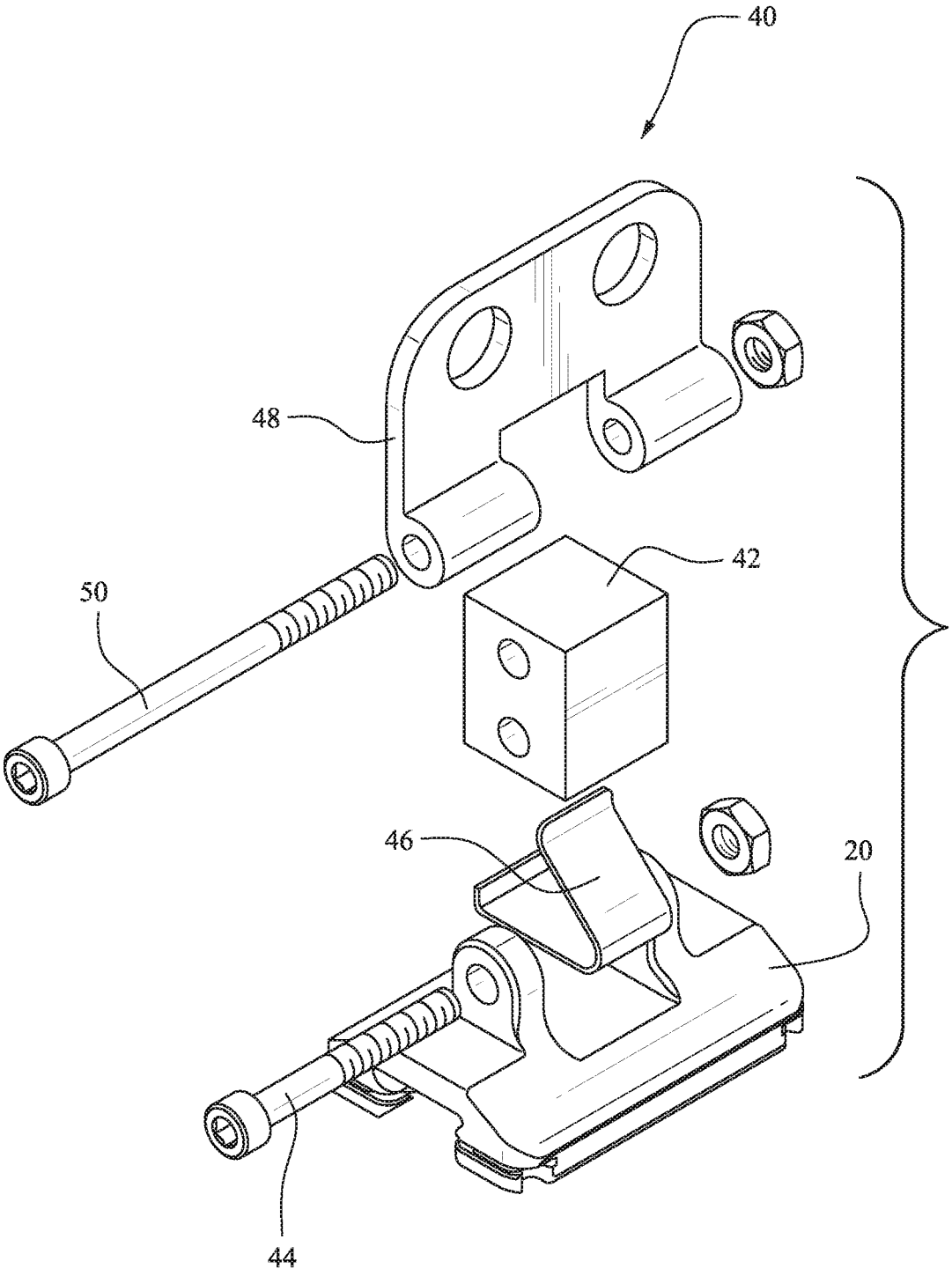
FIG. 8 is an exploded view showing details of the traveler car and the connecting structure to the bows.
Figure 9:
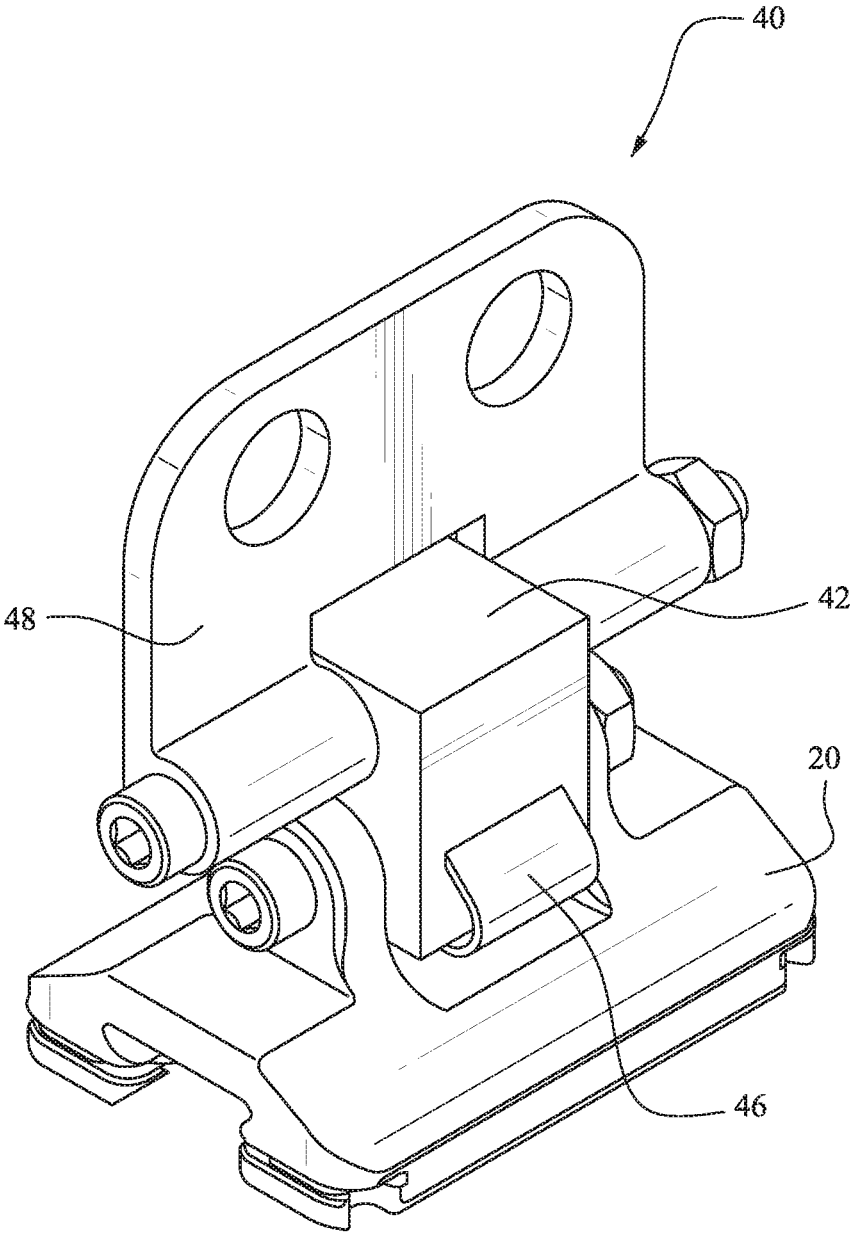
FIG. 9 is a perspective view of the traveler car and hinge assembly.
Figure 10:
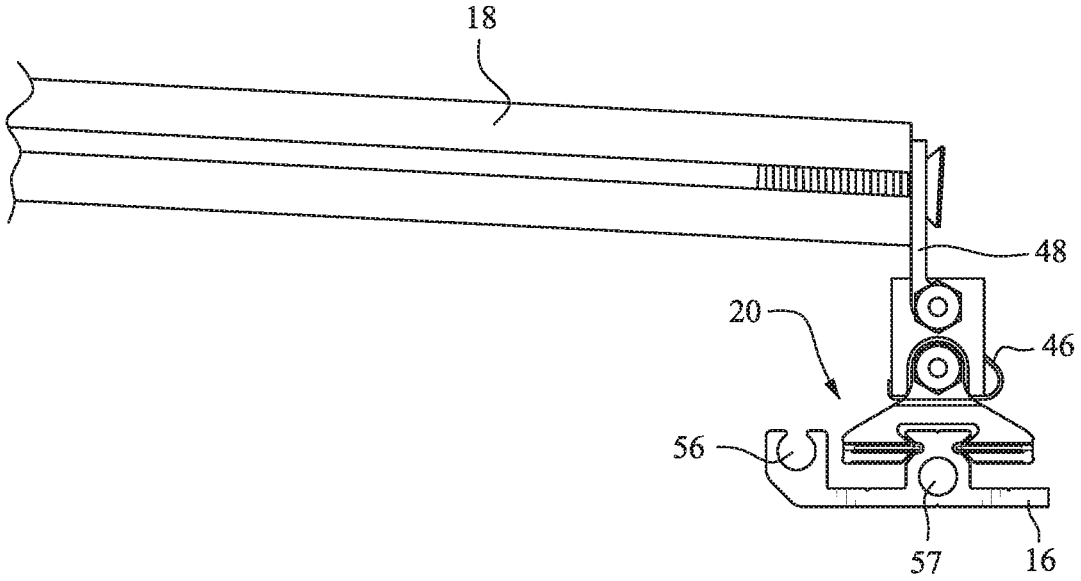
FIG. 10 is an end view of the track on one side of the opening showing the connection between the bows and the hinge assembly.

In some embodiments, the bows 18 are coupled with the traveler cars 20 via a hinge assembly 40. With reference to FIGS. 8-10, each of the hinge assemblies 40 may include a hinge block 42 pivotably secured to respective ones of the traveler cars 20 by a suitable connector 44. A spring member 46 is interposed between the hinge block 42 and the traveler car 20. An end cap 48 is also secured to the hinge block 42 via a suitable connector 50. The bows 18 are secured directly to the end caps 48. The springs 46 of the hinge assemblies on one side of the tracks 16 act in opposition to the corresponding springs 46 of the hinge assemblies 40 on an opposite side of the tracks 16. The hinge assemblies 40 allow for larger variations in lateral alignment of the tracks 16. The hinge assemblies generally create a four-bar link mechanism that allows for lateral movement of the traveler cars to traverse the tracks 16 even if not perfectly parallel. The spring members 46 bias the assemblies in opposite directions (either toward each other or away from each other), thereby centering and stabilizing the bows 18 in a central position.

Figure 11:
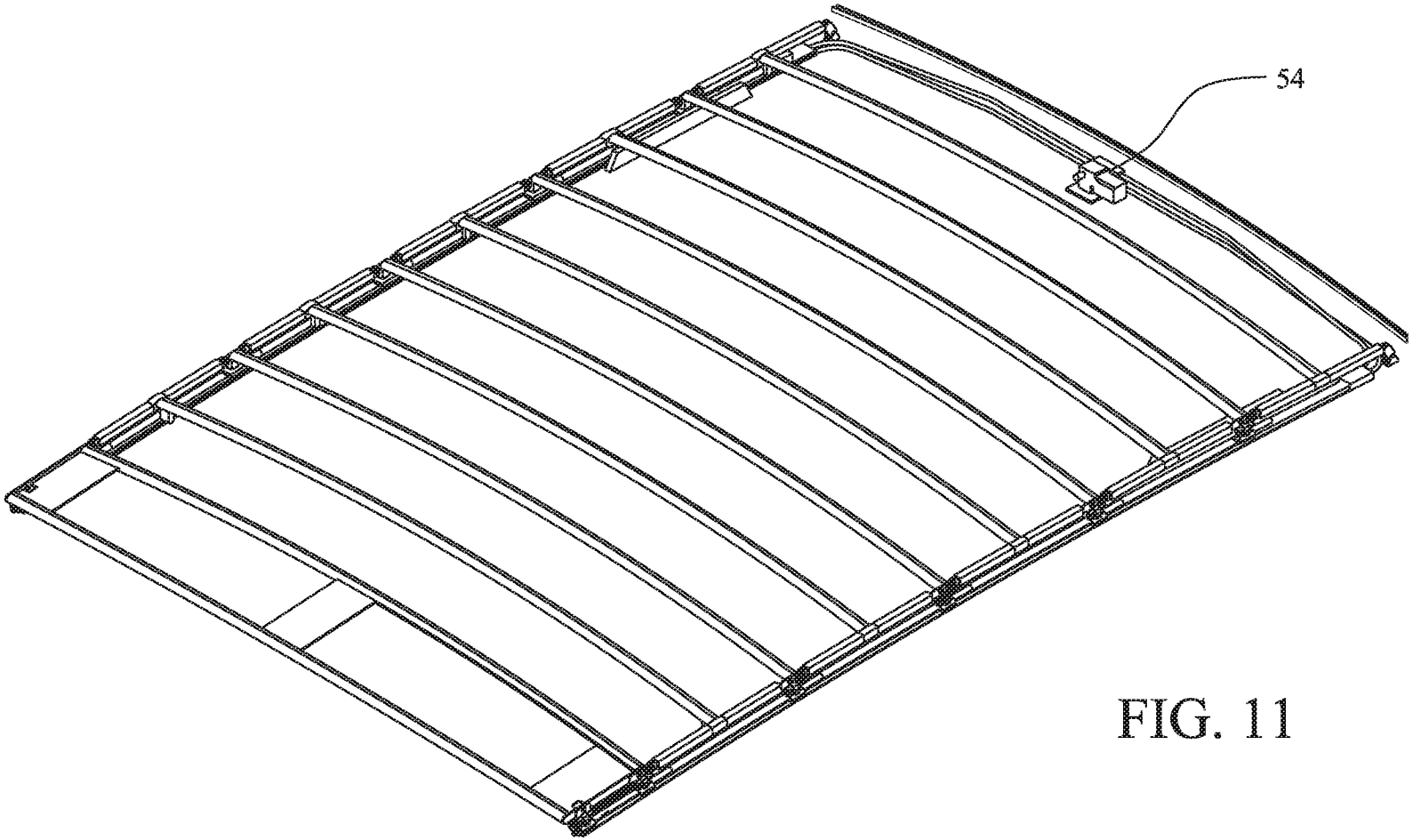
FIGS. 11 and 12 show an alternative embodiment utilizing an electronic motor to displace the retractable roof between its closed and opened positions.
Figure 12:
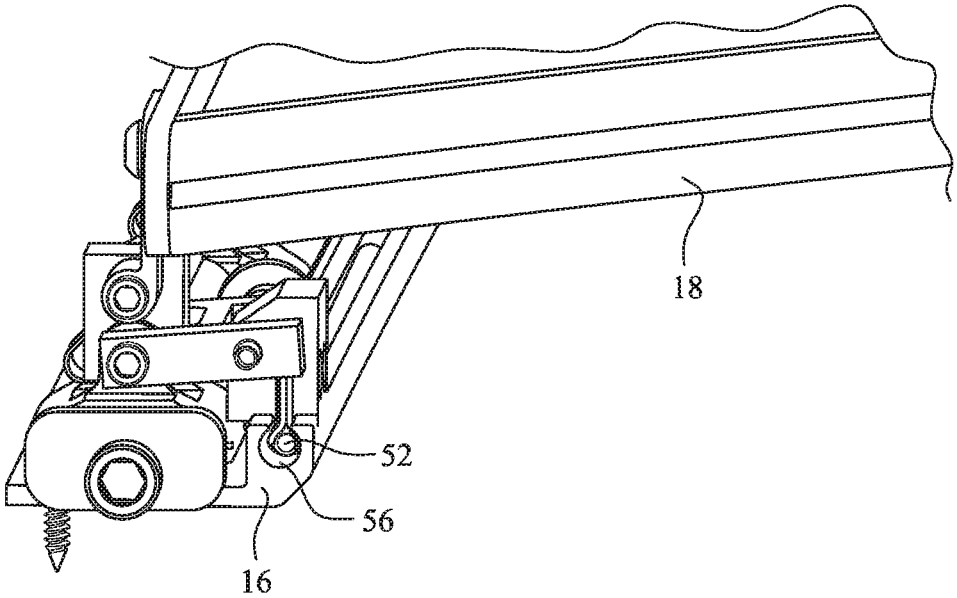

In an alternative embodiment, the traveler cars 20 are connected to a drive cable 52 that is driven in forward and rearward directions by an electric motor 54. In some embodiments, the drive cable is a known spiral cable system driven by the electric motor. Of course, there are alternative ways to accomplish the motorized operation, such as cable pulley drive systems, pneumatic drive systems, ball screw drive motor systems, etc., and the invention is not meant to be limited to the illustrated application. With reference to FIGS. 11 and 12, the drive cable 52 is driven by the electric motor 54 through a cable drive channel 56 in the track 16 (the channel 56 is also shown in the track in FIG. 10). Ends of the drive cable 52 are attached to the end frame assembly 24 or other moving section of the retractable roof 12. As the drive cable 52 is driven in the forward direction, for example, the roof extends; when driven in the aft direction, for example, the roof retracts. The opposite ends of the cable (i.e., the non-driving ends) travel through a return channel 57 (FIG. 10) in the tracks 16.

In the embodiment utilizing an electric motor, the retractable roof can be locked in any position along the tracks. Once the motor is stopped, in a preferred construction, the roof cannot be moved manually without causing damage to the drive system unless the drive system is disengaged.

One feature of the described embodiments is the use of the SureSeal® Snapless attachment system available from Taylor Made Systems to attach the fabric to the water management trough. The trough could be a custom extruded profile where a snapless cavity was designed into it. This could also be a standalone snapless cavity that is attached to a fiberglass structure.

Another feature is the use of the SureSeal® Snapless feature built into the bows, which provides for the attachment of the cover fabric to the bows along the top of the roof. This same feature may be used to attach the headliner fabric to the underside of the bows. In the ends of the bow profile, one or more of the cavities may be used to attach the hinged attachments that eventually attach to the traveler cars. In the example shown in the drawings, the attachment of the hinge to the traveler is direct, which allows for minimal manufacturing and assembly variances and minimal attachment variances to the boat cover structure.

As an alternative to permitting the roof structure to fold on itself as the retractable roof is displaced from the closed position to the opened position, the assembly may include known intermediate lift arms to lift the fabric or other material (outer and headliner) out of the way as the roof is retracted.

The retractable roof can open from forward to aft or aft to forward. Alternatively, the roof could have two moving sections, such as the end frame assembly, that move in both directions toward the center. This configuration would allow for the roof to open from forward to aft and lock at discrete locations anywhere between. It would similarly allow the roof to open from aft to forward and lock at discrete locations anywhere between. A roof forward section could also open toward aft and lock somewhere around the center, while an aft section could open toward the forward end and lock centrally. This would provide for two openings (one forward and one aft) with an enclosed area between them.

In the exemplary application to a boat structure, the inclusion of a retractable roof provides significant advantages. The manual or motor driven operation of the mechanism located within, on or attached to the boat cover structure is readily reconfigurable to meet the demands of the boat occupants. The retractable roof provides for partial protection from the elements with the ability to change the amount of protection or access to the elements. The roof provides the ability to experience an on-demand open air feeling and the ability to control the degree of protection or access to the elements. As noted, the manual embodiment can incorporate discrete locking positions, while the motor driven embodiment can have an unlimited number of locking positions. When closed, the roof offers water and sun protection of a standard roof cover. Water resistance is provided through a water management trough that is located beneath the retractable portion of the roof, thereby routing any water that passes between the fixed and moving portions of the roof into the trough and out of the boat through appropriate plumbing. A headliner feature covering the inner portion of the roof can be provided, which can be attached using the Taylor Made Systems SureSeal® Snapless system.

The attachment of a fabric enclosure to the retractable portion of the enclosure may be made available through the use of the SureSeal® snapless system, where the perimeter of the retractable trough incorporates a snapless track. The flexible SureSeal® profile is sewn to the edge of the fabric and then inserted into the snapless track, which provides for a sealed (water resistant) attachment between the fabric and the retractable structure.

With a fabric roof, the fabric portion of the roof can be dielectrically welded, heat welded, glued or the like along all seams to provide for a water resistant cover. The fabric can also be conventionally sewn or stitched.

Figure 13:
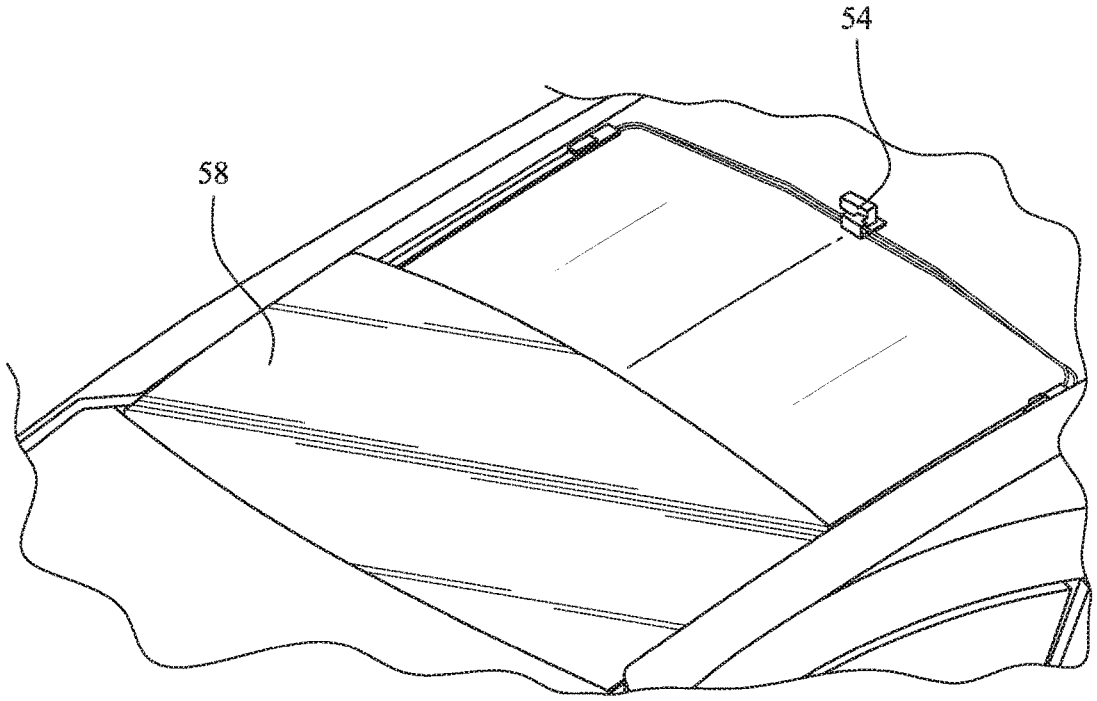
FIG. 13 shows an alternative embodiment with a rigid roof material.

FIG. 13 shows an alternative embodiment utilizing the linkage system described above with a rigid roof structure 58. Exemplary roof materials may include Fiberglass Reinforced Plastic (FRP), Glass Reinforced Plastic (GRP), glass, or the like. Rather than folding on itself, the rigid roof structure 58 is displaced up and over (as shown) or down and under the opening 14.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

The invention claimed is:

1. A retractable roof positionable in an opening, the retractable roof comprising:

a pair of tracks oriented lengthwise along opposite sides of the opening;

an end frame assembly extending across the opening between the tracks and including a bow frame secured to end frame traveler cars movably mounted on the tracks, the bow frame including at least two bows secured together by a framework with at least one connector plate, and the bow frame extending across the opening between the tracks; and a flexible roof material sized to cover the opening and secured to the end frame assembly, wherein the end frame assembly is displaceable between a closed position and an opened position, the flexible roof material being configured to fold on itself as the end frame assembly is displaced to the opened position.

2. A retractable roof according to claim 1, further comprising an interim bow assembly including an interim bow extending across the opening between the tracks and secured to bow traveler cars movably mounted on the tracks, wherein the flexible roof material is secured to the interim bow assembly, and wherein the interim bow assembly is displaceable with the end frame assembly between the closed positioned and the opened position.

3. A retractable roof according to claim 2, wherein the end frame assembly is secured to the end frame traveler cars and the interim bow assembly is secured to the bow traveler cars by respective hinge assemblies, each of the hinge assemblies including a hinge block pivotably secured to respective ones of the traveler cars and a spring interposed between the hinge block and the respective ones of the traveler cars, wherein the bow frame and the interim bow are secured to the hinge block of a respective hinge assembly, the springs of the hinge assemblies on one side of the tracks acting in opposition to the springs of the hinge assemblies on an opposite side of the tracks.

4. A retractable roof according to claim 2, comprising at least two of the interim bow assembly.

5. A retractable roof positionable in an opening, the retractable roof comprising:

a pair of tracks oriented lengthwise along opposite sides of the opening;

an end frame assembly extending across the opening between the tracks and including a bow frame secured to end frame traveler cars movably mounted on the tracks;

a flexible roof material sized to cover the opening and secured to the end frame assembly, wherein the end frame assembly is displaceable between a closed position and an opened position, the flexible roof material being configured to fold on itself as the end frame assembly is displaced to the opened position; and a plurality of locking blocks positioned adjacent the tracks and spaced along a length of the tracks, wherein the end frame assembly comprises a latch mechanism selectively engageable with the locking blocks.

6. A retractable roof according to claim 5, wherein the locking blocks each comprise a cavity or slot, and wherein the latch mechanism comprises a spring plunger that is selectively engageable with the cavities/slots in the locking blocks, the spring plunger being biased toward an engaged position.

7. A retractable roof according to claim 6, wherein the latch mechanism comprises a pull cord connected to a cable, the cable being connected to the spring plunger, wherein displacement of the pull cord serves to displace the cable and retract the spring plunger against the bias.

8. A retractable roof according to claim 6, wherein the locking blocks comprise fore and aft tapered surfaces.

9. A retractable roof according to claim 1, wherein the end frame traveler cars are connected to a drive cable, the retractable roof further comprising an electric motor that drives the drive cable in forward and rearward directions.

10. A retractable roof positionable in an opening, the retractable roof comprising:

a pair of tracks oriented lengthwise along opposite sides of the opening;

a plurality of traveler cars displaceable on the tracks;

a plurality of bows coupled with the traveler cars and extending between the tracks and across the opening, the bows being displaceable with the traveler cars between a closed position and an opened position;

a roof material sized to cover the opening and secured to the bows, wherein the roof material is configured to either fold on itself as the bows are displaced to the opened position or to be displaced up and over or down and under the opening as the bows are displaced to the opened position, wherein the bows are secured to the traveler cars by respective hinge assemblies, each of the hinge assemblies including a hinge block pivotably secured to respective ones of the traveler cars and a spring interposed between the hinge block and the respective ones of the traveler cars, wherein the bows are secured to the hinge block of a respective hinge assembly, the springs of the hinge assemblies on one side of the tracks acting in opposition to the springs of the hinge assemblies on an opposite side of the tracks.

11. A retractable roof positionable in an opening, the retractable roof comprising:

a pair of tracks oriented lengthwise along opposite sides of the opening;

a plurality of traveler cars displaceable on the tracks;

a plurality of bows coupled with the traveler cars and extending between the tracks and across the opening, the bows being displaceable with the traveler cars between a closed position and an opened position;

a roof material sized to cover the opening and secured to the bows, wherein the roof material is configured to either fold on itself as the bows are displaced to the opened position or to be displaced up and over or down and under the opening as the bows are displaced to the opened position, wherein the bows are manually displaceable, the retractable roof further comprising a handle secured adjacent the bows on an underside of the bows.

12. A retractable roof according to claim 11, wherein two of the bows are connected together by a framework to define an end frame assembly.

13. A retractable roof according to claim 12, further comprising a latch mechanism coupled with the end frame assembly, the latch mechanism locking the end frame assembly in one of a plurality of positions between the closed position and the opened position.

14. A retractable roof according to claim 13, further comprising a plurality of locking blocks positioned adjacent the tracks and spaced along a length of the tracks, wherein the latch mechanism is selectively engageable with the locking blocks, wherein the locking blocks each comprise a slot or cavity, and wherein the latch mechanism comprises a spring plunger that is selectively engageable with the slots/cavities in the locking blocks, the spring plunger being biased toward an engaged position, wherein the latch mechanism comprises a pull cord connected to a cable, the cable being connected to the spring plunger, wherein displacement of the pull cord serves to displace the cable and retract the spring plunger against the bias.

15. A retractable roof according to claim 10, wherein the traveler cars are connected to a drive cable, the retractable roof further comprising an electric motor that drives the drive cable in forward and rearward directions.

16. A retractable roof according to claim 10, wherein the roof material comprises a flexible material that folds on itself as the bows are displaced to the opened position.

17. A retractable roof according to claim 10, wherein the roof material comprises a rigid material that is displaced up and over or down and under the opening as the bows are displaced to the opened position.

* * * * *